US005152877A

United States Patent [19]

Nishino et al.

[11] Patent Number: 5,152,877

[45] Date of Patent: Oct. 6, 1992

[54] METHOD FOR PRODUCING SUPPORT FOR PRINTING PLATE

[75] Inventors: Atsuo Nishino; Tsutomu Kakei, both of Shizuoka, Japan

[73] Assignee: Fuji Photo Film Co., Ltd., Kanagawa, Japan

[21] Appl. No.: 593,928

[22] Filed: Oct. 5, 1990

[30] Foreign Application Priority Data

| | | | |
|---|---|---|---|
| Oct. 13, 1989 | [JP] | Japan | 1-265286 |
| Oct. 13, 1989 | [JP] | Japan | 1-265287 |
| Oct. 13, 1989 | [JP] | Japan | 1-265288 |
| Dec. 4, 1989 | [JP] | Japan | 1-313457 |
| Dec. 4, 1989 | [JP] | Japan | 1-313458 |

[51] Int. Cl.[5] ..... C25F 3/04

[52] U.S. Cl. ..... 204/129.4; 204/129.75

[58] Field of Search ..... 204/27, 29, 33, 38.3, 204/129.35, 129.4, 129.75

[56] References Cited

U.S. PATENT DOCUMENTS

| | | | |
|---|---|---|---|
| 3,887,447 | 6/1975 | Sheasby et al. | 204/129.4 |
| 4,166,015 | 8/1979 | Raether | 204/129.75 |
| 4,332,651 | 6/1982 | Bemis et al. | 204/129.4 X |
| 4,482,434 | 11/1984 | Pliefke | 204/33 |
| 4,482,444 | 11/1984 | Frass et al. | 204/129.4 X |
| 4,502,925 | 3/1985 | Walls | 204/33 |
| 4,614,570 | 9/1986 | Pliefke | 204/129.65 X |
| 4,919,774 | 4/1990 | Minato et al. | 204/129.4 |

FOREIGN PATENT DOCUMENTS

| | | |
|---|---|---|
| 1487035 | 12/1975 | European Pat. Off. . |
| 0268790 | 7/1987 | European Pat. Off. . |
| 2204325 | 5/1988 | European Pat. Off. . |
| 3828291 | 8/1988 | European Pat. Off. . |

*Primary Examiner*—Donald R. Valentine

*Attorney, Agent, or Firm*—Sughrue, Mion, Zinn, Macpeak & Seas

[57] ABSTRACT

A method for producing a printing plate support without using sodium hydroxide is provided. An aluminum plate is subjected to cathodic electrolysis in a neutral salt aqueous solution, electrochemically surface-roughened in an acid aqueous solution, and subjected to cathodic electrolysis in one of an acid aqueous solution or a neutral salt aqueous solution to remove smut. Further, a common DC power source is used for cathodic electrolytic treatment and for anodizing treatment. To prevent sparks, an AC current is partially shunted before use in cathodic electrolysis. Finally, an aluminum plate is first electrolytically treated as a cathode in a neutral salt electrolyte, and then is electrochemically surface-roughened in an acid aqueous solution.

4 Claims, 6 Drawing Sheets

METHOD FOR PRODUCING SUPPORT FOR PRINTING PLATE

BACKGROUND OF THE INVENTION

The present invention generally relates to a method for producing an aluminum support for a printing plate, and particularly relates to a method for electrochemically surface-roughening and electrochemically denaturing an aluminum plate (including an aluminum alloy plate). Specifically, the present invention relates to a method for producing an aluminum support for a printing plate constituted by a uniformly surface-roughened aluminum plate suitable for an offset printing plate.

Conventionally, an aluminum plate has been used as a support for an offset printing plate. Usually, the surface of the aluminum plate is surface-roughened for the purposes of improving adhesion between the aluminum plate and a photosensitive layer provided thereon, holding damping water to be used in printing, and the like.

As the method for such surface roughening, a mechanical surface-roughening method, such as ball graining or brush graining, has been used. Alternatively, an electrolytic surface-roughening method for electrochemically surface-roughening the surface of an aluminum plate in an acid electrolyte such as hydrochloric acid or nitric acid has been used.

After the mechanical surface-roughening treatment such as ball graining, brush graining, or the like, an etching treatment in an alkaline solution has been generally performed so as to remove an abrasive used in the mechanical surface-roughening and make the surface shape well. After the electrochemical surface-roughening treatment, on the other hand, etching treatment in an alkaline solution has been ordinarily performed so as to remove a smut component mainly containing a generated aluminum hydroxide and to shape the surface. As the alkaline solution, generally sodium hydroxide has been used.

FIG. 6 shows an example of the conventional process in in which, after surface roughening, alkali etching and anodizing are performed so as to shape the surface-roughened support and to form an oxide coating. That is, first, a surface-roughened aluminum plate 1 is alkali-etched through ejection of an alkaline solution from spray nozzles 6 in the alkali etching step E. The remaining alkaline solution is removed through injection of clean water from spray nozzles 5 in the washing step W, and then the surface of the aluminum plate is neutralized through injection of a dilute acid aqueous solution from spray nozzles 7 in the neutralization step N. Thereafter, the aluminum plate is placed opposite to an anode of a DC power source 2 in an acid electrolyte 9 so as to be surface-electrolyzed in the cathodic electrolytic step, and then placed opposite to a cathode of the DC power source 2 so as to be surface-oxidized so that an oxide coating is formed in the anodizing step A.

As noted above, an electrolytic surface-roughening method for electrochemically surface-roughening the surface of an aluminum plate in an acid electrolyte has attracted attention. According to this electrolytic surface-roughening method, an aluminum plate having a uniformly roughened surface in which the mean roughness distribution is small in comparison with a plate produced using the conventional mechanical surface-roughening method is obtained. The conditions for obtaining such a roughened surface, however, are exceedingly narrow. If conditions such as the electrolyte composition, temperature, and the electrolytic condition are fixed, it is possible to easily obtain aluminum plates having extremely reduced scattering of products and having uniform performance. Since processing oil, atmospheric oxygen, and moisture are complicatedly intertwined with aluminum in rolling and processing, oxides or smut unevenly exist on the surface of an aluminum plate. If an aluminum plate in such a state is immediately electrolytically surface-roughened, a uniform surface-roughening treatment cannot be performed, thereby sometimes the roughening treatment of the plate is uneven. Such unevenness is undesirable. When a coating is formed on the aluminum surface, such unevenness causes deterioration in the adhesive property of the coating.

Therefore, conventionally, an aluminum material has been immersed in an acid aqueous solution or in an alkaline solution before an electrolytic surface-roughening treatment is performed to thereby remove processing oil, oxide, or smut and to dissolve a processed degenerated layer so that the surface is washed and made uniform.

A method in which removal of rolling oil or a natural oxide coating existing on the surface of an aluminum plate is performed in an alkaline solution such as sodium hydroxide prior to electrolytic surface roughening is known from Japanese Unexamined Patent Publication No. Sho-54-65607.

As the electrolytic surface-roughening method, there are generally known methods as disclosed, for example, in the U.S. Pat. Nos. 4,548,683 and 4,087,341. When electrochemical surface-roughening is performed using an AC current, carbon electrodes are usually employed as counter electrodes for the aluminum plate to be surface-roughened. When using carbon as counter electrodes, however, the carbon electrodes are dissolved because of deterioration of a binder, as described in Japanese Patent Publication No. Sho-61-48596. Then, according to the published patent, auxiliary electrodes are used and a current flowing in the main electrodes is shunted using rectifier devices such as diodes so that the quantity of the current flowing out from the main electrodes is reduced so as to be smaller than the current flowing into the main electrodes to thereby prevent the main electrodes from being dissolved. Examples of the application of this method are disclosed, for example, in of U.S. Pat. Nos. 4,533,444, 4,597,853 and 4,536,264.

As the method for electrochemically surface-roughening an aluminum plate in a neutral salt aqueous solution, on the other hand, a method disclosed in Japanese Unexamined Patent Publication No. Sho-52-26904 is known. Further, Japanese Unexamined Patent Publication No. Sho-59-11295 discloses a method for electrochemically denaturing the surface of an aluminum plate by cathodic electrolysis in a neutral salt aqueous solution. It is described that in a neutral salt aqueous solution of pH 6–8, which is a particularly advantageous condition, dissolved aluminum ions can be continuously removed from the neutral salt aqueous solution by filtration or centrifugal separation because the aluminum ions are precipitated in the form of aluminum hydroxide or aluminum oxide hydrate.

However, when a support for a printing plate is electrolytically surface-roughened, a washing treatment using sodium hydroxide is usually used for performing degreasing and removing a natural oxide coating before the electrolytic surface-roughening treatment, and a light etching treatment using sodium hydroxide is used to remove aluminum hydroxide generated in the electrolytic surface-roughening treatment and to shape the edge portions of formed pits after the electrolytic surface-roughening treatment. Both treatments involve a chemical dissolution reaction due to sodium hydroxide, and it has been therefore difficult to suppress the quantity of dissolution. Further, since a permeable membrane is used for removal of aluminum dissolved in the sodium hydroxide, the required liquid waste treatment cost is costly.

Further, since an auxiliary electrode used in the known method is provided for preventing dissolution of the main electrodes, and any reaction at the auxiliary electrode does not contribute to the surface-roughening reaction, equipment costs are high. For example, in the case of separately providing an auxiliary electrode cell as disclosed in U.S. Pat. No. 4,533,444, particularly, there has been a large disadvantage in equipment cost.

Therefore, a first object of the present invention is to eliminate the foregoing disadvantages in the prior art and provide a method for producing a support for a printing plate in which the conventional sodium hydroxide pretreatment such as for degreasing of an aluminum plate and smut removal is changed into an electrolytic treatment to thereby simplify liquid waste disposal. A part of an electrolytic surface-roughening reaction is performed by an auxiliary electrode, which has not directly contributed to the reaction in the conventional method, so that the process is further simplified to thereby improve production costs.

Further, in the immersion of an aluminum plate in an alkaline solution, for example, immersion in a sodium hydroxide aqueous solution, a large quantity of aluminum is dissolved, which reduces the life of the liquid. Also, because the immersion is a rapid chemical dissolving reaction, perforation or blowout in a sheet is liable to occur if the sheet is thin. Moreover, removal of metal ions, mainly, aluminum ions, from a sodium hydroxide aqueous solution has to depend on a method employing an ion-permeable membrane, which is relatively high in equipment cost.

In order to solve these problems, a method in which the surface of an aluminum plate is electrochemically denatured by cathodic electrolysis in a neutral salt aqueous solution has been disclosed in Japanese Unexamined Patent Publication No. Sho-59-11295, as noted above. To realize such a method, referring to FIG. 7, a surface-roughened aluminum plate 1 is subject to cathodic electrolytic treatment in the cathodic electrolytic step C in a neutral salt aqueous solution 8 at between an anode 3 and the aluminum plate 1, which is energized from a DC power source 2 through a conductor roll 10, so that the roughened surface of the support is shaped. The thus treated aluminum plate is washed with clean water in a washing step W, and then treated in an anodizing step A, as shown in FIG. 7. In this step, an oxide coating is formed on the aluminum plate surface in the same manner as in the case of FIG. 6.

In this method, however, there has been a disadvantage in that it is necessary to separately provide a power source to be used for cathodic electrolysis, and sparks are generated between the conductor roll and the aluminum plate because current conduction is performed using the conductor roll. As a result, holes are apt to be formed through the aluminum plate.

Therefore, a second object of the present invention is to overcome the limitations of the prior art in which a separate power supply must be provided for cathodic electrolysis, causing sparks to be generated which causes holes in the aluminum plate.

FIG. 11 shows another example of a conventional process. In this example, an aluminum plate 1 which has been subject to alkali-pretreatment and washed with water is electrolytically surface-roughened in an acid electrolyte 100 between the aluminum plate and main electrodes 4 using an AC power source 20. Next, the thus treated aluminum plate 1 is subject to cathodic electrolysis in a neutral salt aqueous solution between the aluminum plate and an anode 7 which is energized by a DC power source 2 through a conductor roll 10 to thereby remove aluminum hydroxide from the roughed surface. In this case, however, a possibility exists that holes will form in the aluminum plate by sparks generated between the conductor roll 8 and the aluminum plate.

Finally, although a washing treatment using sodium hydroxide is usually performed for the purposes of performing degreasing and removing a natural oxide coating before the electrolytic surface-roughening treatment, the treatment is a chemical dissolution reaction involving sodium hydroxide. Therefore, it has been difficult to suppress the quantity of dissolution. Further, there has been a disadvantage in that, since an etching treatment is performed using a strong alkali, holes are apt to be formed in the aluminum plate. Moreover, the liquid waste disposal cost is increased because a permeable membrane or the like must be used for removal of aluminum dissolved in sodium hydroxide.

Therefore, a third object of the present invention is to provide a method for producing a support for a printing plate in which holes are not formed in the aluminum plate due to a strong alkali used in the etching treatment.

SUMMARY OF THE INVENTION

The above first object of the present invention is attained by a method for producing a support for a printing plate in which an aluminum plate is continuously surface-roughened, characterized in that (a) the aluminum plate is subjected to cathodic electrolysis in a neutral salt aqueous solution, (b) the treated aluminum plate is electrochemically surface-roughened in an acid electrolyte, and then (c) the treatment aluminum plate is subjected to cathodic electrolysis in an acid electrolyte.

The above first object is also obtained by a method for producing a support for a printing plate in which an aluminum plate is continuously surface-roughened, characterized in that (a) the aluminum plate is subject to cathodic electrolysis in a neutral salt aqueous solution, (b) the thus treated aluminum plate is electrochemically surface-roughened in an acid electrolyte, and then (c) the treated aluminum plate is subject to cathodic electrolysis in a neutral salt aqueous solution.

The second object of the present invention is attained by a method for producing a support for a printing plate in which a surface-roughened aluminum plate is electrolytically treated as a cathode in a neutral salt aqueous solution and then anodized, characterized in that a DC power source is commonly used as a power source for the cathodic electrolytic treatment and as a power source for the anodizing treatment.

The above second object of the present invention can also be attained by the method for producing a support for a printing plate in which an aluminum plate is continuously electrochemically surface-roughened in an acid electrolyte using an AC current, characterized in that the current to be used for the surface roughening is partially shunted through rectifier devices so that the thus obtained shunted current is used for cathodic electrolysis in a neutral salt aqueous solution. Shunting of a part of current to be used for surface-roughened through rectifier devices as used herein refers to shunting performed using diodes, thyristors, GTOs, transistors or the like.

The third object of the present invention can be attained by providing a method in which, after being electrolytically treated as a cathode in a neutral salt electrolyte, an aluminum plate is electrochemically surface-roughened in an acid aqueous solution.

DESCRIPTION OF THE PREFERRED EMBODIMENTS

Preferred embodiments of the present invention will be described with reference to the accompanying drawings.

Figure 1:
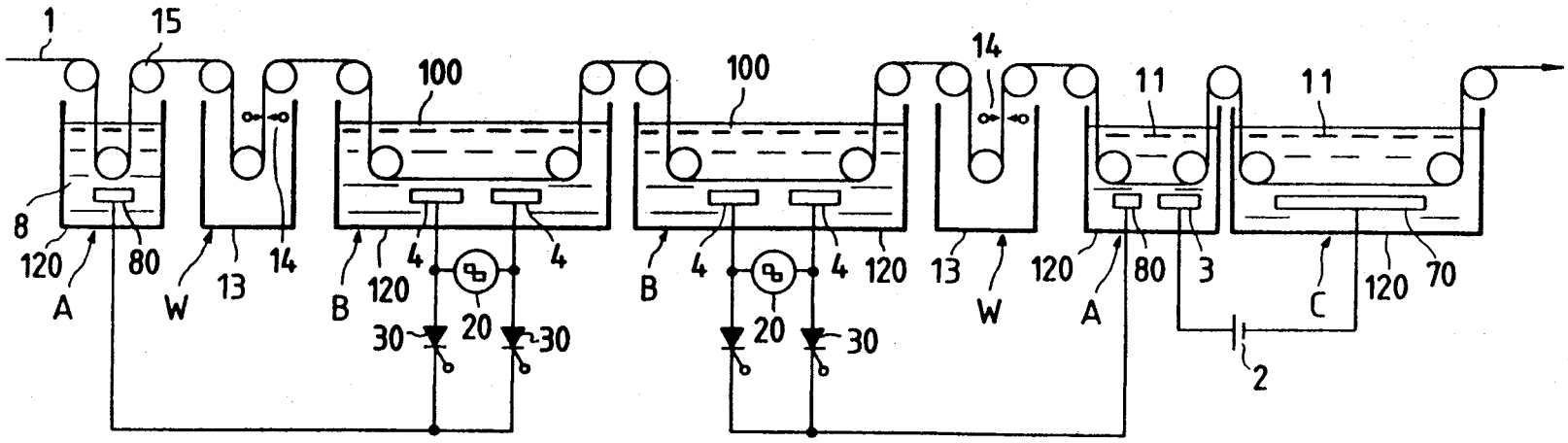
FIG. 1 is a schematic view of treatment equipment for practicing a first embodiment of the present invention.

In FIG. 1, an aluminum plate 1 is subjected to a cleaning treatment such as degreasing in a cathodic electrolysis step A, which is pretreatment. The thus treated aluminum plate 1 is subject to an AC surface-roughening treatment in the first (and second) step of the electrolytic surface-roughening treatment step B, and then removal of smut is performed in the cathodic electrolysis step A. In the drawing, further shown is the anodizing step C as the next step. This step, however, is not always needed in the method according to the present invention.

In the cathodic electrolysis step A, which is the pretreatment, a DC current shunted from an AC power source 20 through thyristor rectifying devices 30 (hereinafter, simply referred to as thyristors) is fed to an auxiliary electrode 80 to thereby DC-electrolyze the aluminum plate 1 disposed in opposition to the auxiliary electrode as a cathode in a neutral salt aqueous solution 9 so as to wash the surface of the aluminum plate. The thus pretreated aluminum plate 1 is washed with water from washing sprays 14 in the washing step W, and then subjected to the electrolytic surface-roughening treatment step B of the first and second steps so as to be electrolytically surface-roughened in acid electrolytes 100 by main electrodes 4 disposed in opposition to the aluminum plate 1 and fed from the AC power sources 20. Although the electrolytic surface-roughening treatment process of the two steps is shown in the accompanying drawings, only the electrolytic surface-roughening treatment process of one step is sometimes sufficient. The surface-roughened aluminum plate is washed with water by the washing sprays 14 in the washing step W, and then sent to the cathodic electrolysis step A. Here, a DC current shunted from the AC power source 20 through thyristors 30 is fed to an auxiliary electrode 80 and the aluminum plate 1 disposed in opposition to the auxiliary electrode is subject to DC cathodic electrolysis as a cathode in an acid electrolyte 11, so that smut on the surface of the surface-roughened aluminum plate is removed and at the same time the edge portions of pits formed are shaped. In the drawing, further shown is the anodizing step C as the next step. This step, however, may be omitted.

The anodizing step C in the acid electrolyte 11, on the other hand, is a treatment process performed between a cathode 70 fed from the DC power source 2 and the aluminum plate in the acid electrolyte so as to improve the water holding property of the surface-roughened aluminum plate. In the drawing, shown is an anode 3 provided in a cell for the cathodic electrolysis step A which is the pre-process so that the anode 3 is fed from the DC power source for anodizing. The electrode 6 is illustrated for showing an example in which the electrode 6 is used together with an auxiliary electrode 80 to thereby improve the electrolytic treatment efficiency.

Next, the required conditions of the present invention will be successively described.

As the aluminum plate to be applied to the present invention, a pure aluminum plate or an alloy plate containing aluminum as a principal component can be used.

The electrochemical washing treatment for the surface of an aluminum plate as defined according to the present invention means that a DC current is fed to an electrode and an aluminum plate disposed in opposition to the electrode is subject to cathodic electrolysis as a cathode in a neutral salt aqueous solution. The salt aqueous solution as used in the practice of the present invention is an aqueous solution of a salt such as disclosed in Japanese Unexamined Patent Publications Nos. Sho-52-26904 and Sho-59-11295, for example, an alkali metal halide or alkali metal nitrate, particularly preferably, sodium chloride or sodium nitrate. It is preferable to select the pH and the concentration to be 6–8 and 0.1–10%, respectively. It is preferable to select the liquid temperature to be 40°–70° C.

As the electrode disposed in opposition to an aluminum plate so as to perform the cathodic electrolysis according to the present invention, platinum, ferrite, iridium oxide, and the like may be used, and ferrite and iridium oxide are particularly preferable. Preferably, the current density of the DC current to be used for the cathodic electrolysis as defined according to the present invention is selected to be in a range from 0.1 to 100 $A/dm^2$, and the electrolytic treatment time is selected to be in a range from 1 to 90 seconds.

A DC power source for exclusive use in the cathodic electrolysis in the neutral salt aqueous solution may be provided. Alternatively, a part of the power source to be used for the electrolytic surface-roughening may be used as the DC power source. Particularly when continuous electrochemical surface roughening is performed on an aluminum plate using an AC current, it is preferable that a part of the current to be used for the surface roughening treatment is shunted through a rectifier and the shunted current used for the cathodic electrolysis in the neutral salt aqueous solution. The shunting of a part of the current used for surface-roughened through rectifier devices as defined according to the present invention means that shunting is performed by using diodes, thyristors, GTOs, transistors or the like. The current adjustment in the cathodic-electrolysis washing treatment in the neutral salt aqueous solution at this time can be controlled on the basis of the rat%w of the area between the main electrodes and the electrode to be used for the cathodic electrolysis or ignition timing of thyristors GTOs, or transistors.

Electrochemical surface-roughening using an AC current in an acid electrolyte as defined according to the present invention means that an AC current is supplied across an aluminum plate and a counter electrode in an acid electrolyte containing metal ions to thereby perform electrochemical surface-roughening on the aluminum plate. The acid electrolyte as used in the practice of the present invention may be any of those used for electrochemical surface-roughening using ordinary AC current. However, a particularly preferable acid electrolyte is a solution containing nitric acid in an amount of 5–20 g/l or hydrochloric acid in an amount of 5–20 g/l. A salt group containing $NO_3^-$ or $Cl^-$, such as aluminum nitrate, aluminum chloride, ammonium nitrate, ammonium chloride, manganese nitrate, manganese chloride, iron nitrate, iron chloride, or the like, may be added to the electrolyte. It is a matter of course that metal ions dissolved from an aluminum plate may be further added to the electrolyte as a fine quantity of component in the electrolyte so as to move stably perform surface roughening.

If the electrolytic treatment time is too long or too short, an optimum roughened-surface cannot be obtained. Therefore, it is preferable to select the electrolytic treatment time to be 5–90 seconds. It is preferable to select the current density to be 20–100 A/dm$^2$ and to select the liquid temperature to be 30°–60° C. When a surface-roughening treatment is performed, it is preferable to use a method in which anodes and cathodes are alternately provided.

When a surface-roughening treatment is performed by using an AC current, the frequency of the power source to be used for the surface-roughening treatment can be selected to be in a wide range from 0.1 to 400 Hz in accordance with the kind of an electrolyte. It is preferable to use carbon as the counter electrode for supplying the aluminum plate with an AC current according to the present invention.

The technique whereby an aluminum plate is subject to cathodic electrolysis in an acid electrolyte aqueous solution to remove smut after the electrolytic surface-roughening treatment as defined according to the present invention means that a DC current is supplied to an electrode and an aluminum plate disposed in opposition to the electrode is subjected to cathodic electrolysis while being employed as a cathode in an acid electrolyte aqueous solution so that smut mainly containing aluminum hydroxide on the surface-roughened aluminum plate is removed and at the same time the edge portions of pits formed in the electrolytic surface-roughening treatment are shaped. As the DC current, a current partially shunted from a current to be used for the surface-roughening treatment through rectifying devices may be utilized, or the power source to be used for anodizing may be employed. It is a matter of course that these currents may be used together. In the case of using both currents, simplicity of equipment is realized to thereby make it possible to advantageously perform production. The shunting of a part of the current used for surface-roughened through rectifier devices as defined according to the present invention means that shunting is performed using diodes, thyristors, GTOs, transistors or the like. As the electrode disposed in opposition to an aluminum plate so as to perform the cathodic electrolysis, platinum, ferrite, iridium oxide, and the like may be used, and ferrite and iridium oxide are particularly preferable.

As the acid aqueous solution to be used for the cathodic electrolysis, it is possible to use an aqueous solution such as a phosphoric acid, a sulfuric acid, a chromic acid, a nitric acid, a hydrochloric acid, or the like. It is preferable that the type of the aqueous solution be selected so as to be the same as that of the aqueous solution used for anodizing in the next treatment process. Since, recently particularly, sulfuric acid anodizing has been generally used, it is preferable to use an aqueous solution containing a sulfuric acid by 170–400 g/l. It is preferable to select the current density to be 20–400 A/dm$^2$. If the acid electrolyte used for removal of smut is neutralized so as to be a neutral aqueous solution of pH 6–8, dissolved aluminum ions are precipitated in the form of an aluminum hydroxide or an aluminum oxide hydrate, and therefore the aluminum hydroxide or the aluminum oxide hydrate can be continuously removed from liquid waste by filtration or centrifugal separation.

The current used for cathodic electrolysis may be repeatedly employed because when the linear density of current flowing into an aluminum plate is high, temperature rising of an aqueous solution surface due to heat generation owing to an electric resistor in the aluminum plate increases. Although a description has been made as to the method for producing an aluminum support for a printing plate according to the present invention including the process of electrochemically surface-roughening and electrochemically denaturing an aluminum plate (including an aluminum alloy) in the foregoing embodiment, for example, a washing treatment using a sodium hydroxide aqueous solution may be added to the producing method according to the present invention as a pretreatment, and, alternatively, mechanical surface-roughening may be performed before the above surface-roughening process.

EXAMPLE 1

An example of the present invention will be described hereunder, although the present invention is of course not limited to this example.

A JIS 1050-H18 aluminum plate was continuously electrolytically surface-roughened in the apparatus shown in FIG. 1.

The condition of a neutral salt aqueous solution in pretreatment in which the surface of the aluminum plate was washed by cathodic electrolysis in the neutral salt aqueous solution was such that a 5% sodium chloride aqueous solution was used at a temperature of 60° C.

The DC voltage to be used for the cathodic electrolysis in the sodium chloride aqueous solution was shunted using thyristors from an AC power source to be used for the electrolytic surface-roughening treatment.

The condition of the acid electrolyte in the surface-roughening treatment process in which electrochemical surface-roughening was performed in the acid electrolyte using an alternating current was such that a 1% hydrochloric acid aqueous solution was used at a temperature of 35° C. Two treatment cells were used for the electrolytic surface-roughening treatment. The ratio of area between the electrode used for the cathodic electrolysis in the sodium chloride aqueous solution and the electrode used for the electrolytic surface-roughening treatment in the acid aqueous solution was 1:9. Iridium oxide and carbon were used as the materials of the former and latter electrodes, respectively.

The current density in the cathodic electrolysis in the sodium chloride aqueous solution and in the electrolytic surface-roughening treatment was 25 $A/dm^2$ and 50 $A/dm^2$, respectively.

As the acid aqueous solution in the smut removal treatment process by cathodic electrolysis after the electrolytic surface-roughening, an aqueous solution of 60° C. containing sulfuric acid by 360 g/l was used. As the DC voltage, both a current shunted from the AC power source used for the electrolytic surface-roughening treatment and the current used for anodizing were utilized.

When the surface of the thus treated aluminum plate was observed with a scanning electron microscope, the aluminum plate had a roughened surface so uniform as to be suitable for a printing plate.

According to the first embodiment of the present invention, an aluminum plate is subjected to cathodic electrolysis in a neutral salt aqueous solution, electrochemically surface-roughened in an acid aqueous solution, and then subject to cathodic electrolysis in an acid aqueous solution so as to perform smut removal so that a support for a printing plate can be produced continuously and advantageously without using sodium hydroxide.

Figure 2:
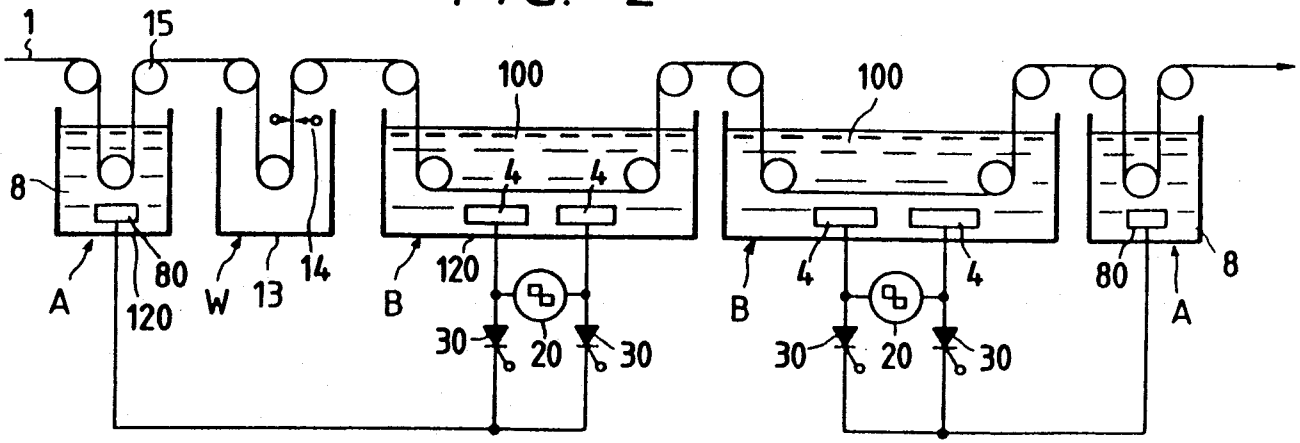
FIG. 2 is a schematic view of treatment equipment for use in carrying out a second embodiment of the present invention.
Figure 3:
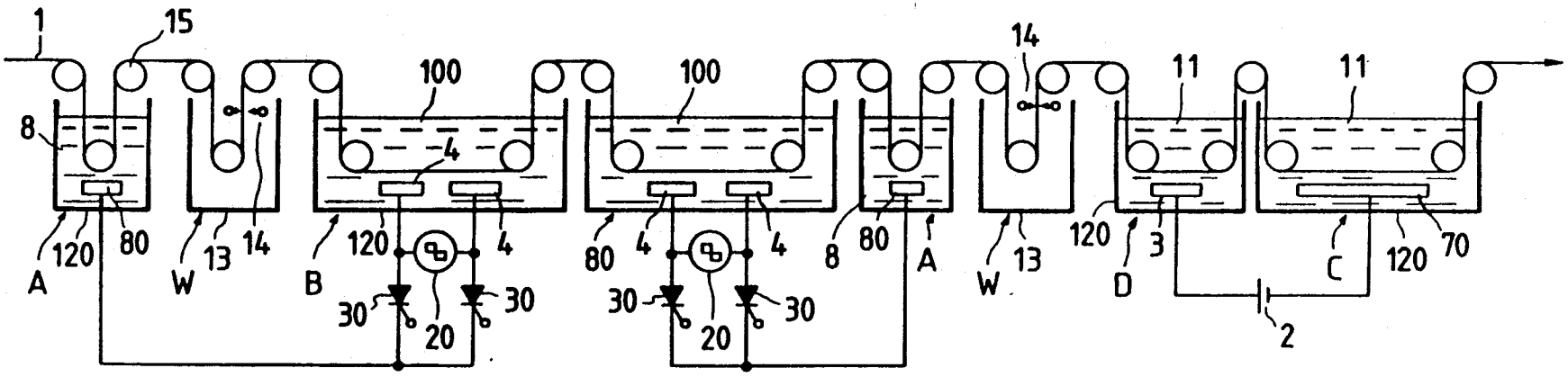
FIG. 3 is a view schematically showing treatment equipment in which a support for cathodic electrolysis and anodizing in acid electrolytes is added to the equipment of FIG. 2.

In a second embodiment of the present invention, FIG. 2 shows a treatment process in which an aluminum plate 1 is subjected to a cleaning pretreatment in the cathodic electrolysis step A in a neutral aqueous solution, the thus treated aluminum plate 1 is subject to an AC surface-roughening treatment in the first (and second) step of the electrolytic surface-roughening treatment step B, and then removal of smut and shaping the edge portions of pits formed in the surface-roughening treatment step are performed in the cathodic electrolysis step A in a neutral aqueous solution. FIG. 3 further shows, as the next step in addition to the step of FIG. 2, the cathodic electrolysis step D and anodizing step C performed for neutralizing the surface of an surface-roughened aluminum plate, removing smut, and improving the water holding property in acid electrolytes. These steps, however, are not always needed in the method according to the present invention.

In the cathodic electrolysis step A, which is the pretreatment, a DC current shunted from an AC power source 20 through thyristor rectifying devices 30 is fed to an auxiliary electrode 80 to thereby DC-electrolyte the aluminum plate 1 disposed in opposition to the auxiliary electrode as a cathode in a neutral salt aqueous solution 8 so as to wash the surface of the aluminum plate.

The thus pretreated aluminum plate 1 is washed with water from washing sprays 14 in the washing step W, and then sent to the electrolytic surface-roughening treatment step B of the first and second steps so as to be electrolytically surface-roughened in acid electrolytes 100 by main electrodes 4 disposed in opposition to the aluminum plate 1 and fed from the AC power sources 20. Although the electrolytic surface-roughening treatment process of the two steps is shown in the accompanying drawings, only the electrolytic treatment process of one step is sufficient. The surface-roughened aluminum plate is sent to the cathodic electrolysis step A in a neutral salt aqueous solution.

Here, a DC current shunted from the AC power source 20 through thyristors 30 is fed to an auxiliary electrode 80 and the aluminum plate 1 disposed in opposition to the auxiliary electrode is subject to DC cathodic electrolysis as a cathode in a neutral salt aqueous solution 8, so that smut on the surface of the surface-roughened aluminum plate is removed and at the same time the edge portions of pits formed in the surface-roughening process are shaped.

FIG. 3 further shows, as the next process, the washing step W and additional treatment including the cathodic electrolysis step D and anodizing step C in acid electrolytes 11, in addition to the process of FIG. 2. This process, however, may be omitted.

The cathodic electrolysis step D in the acid electrolyte 11 is a treatment process performed between an anode 3 fed from a DC power source 2 and an aluminum plate in the acid electrolyte so as to perform neutralization and smut removal. The anodizing step C in the acid electrolyte 11, on the other hand, is a treatment process performed between a cathode 70 fed from the DC power source 2 and the aluminum plate in the acid electrolyte so as to improve the water holding property of the surface-roughened aluminum plate.

Each of FIGS. 20 and 2 shows an example in which currents are shunted from the AC and DC power sources 2 and 3 to the auxiliary electrodes to thereby assign parts in reactions to the auxiliary electrodes which have not directly contributed to the reactions in the conventional method.

Next, the required conditions of the present invention will be successively described. The required conditions are the same as those described above for the first embodiment, with the following additions or exceptions.

It is possible to prevent dissolution of main electrodes by adjusting a current flowing in the main electrodes so that the quantity of current flowing-out from the main electrodes is suppressed so as to be smaller than the quantity of current flowing into the main electrodes as described above. The required conditions of a method for shunting a DC current by utilizing thyristors or the like, an electrode to be used for the cathodic electrolysis, the composition of a neutral salt aqueous solution, and the like are the same as those in the pretreatment cathodic electrolysis in the neutral salt aqueous solution.

An aluminum plate which has been treated by the foregoing treatment method according to the present invention (that is, the process of FIG. 2 of the accompanying drawing) can be further improved to provide support for a printing plate by further imposing it to additional treatment, for example, anodizing in an aqueous solution containing sulfuric acid or phosphoric acid and immersion into a sodium silicate aqueous solution. It is preferable that an aluminum plate after cathodic electrolysis in a neutral salt aqueous solution for removal of smut be washed with water, subject to cathodic electrolysis in an acid electrolyte, and anodized (the latter half treatment of FIG. 2 of the accompanying drawing). As the acid aqueous solution at this time, an aqueous solution such as phosphoric acid, sulfuric acid, chromic acid, nitric acid, hydrochloric acid, or the like can be used. It is preferable that the kind of the acid aqueous solution be selected so as to be the same as the kind of an aqueous solution used for anodizing in the next treatment process.

EXAMPLE 2

An example of this embodiment of the present invention will be described hereunder, while the present invention is not limited to this embodiment.

A JIS 1050-H18 aluminum plate was continuously electrolytically surface-roughened in the apparatus shown in FIG. 2.

The condition of a neutral salt aqueous solution in pretreatment in which the surface of the aluminum plate was washed using a cathodic electrolysis treatment in the neutral salt aqueous solution was such that a 5% sodium chloride aqueous solution was used at a temperature of 60° C.

A DC voltage to be used for the cathodic electrolysis in the sodium chloride aqueous solution was shunted using the thyristors from an AC power source to be used for the electrolytic surface-roughening treatment.

The condition of an acid electrolyte in the surface-roughening treatment process in which electrochemical surface-roughening was performed in the acid electrolyte by using an alternating current was such that a 1% of hydrochloric acid aqueous solution was used at a temperature of 35° C. Two treatment cells were used for the electrolytic surface-roughening treatment. The ratio of area between the electrode used for the cathodic electrolysis in the sodium chloride aqueous solution and the electrode used for the electrolytic surface-roughening treatment in the acid electrolyte was 1:9.

Iridium oxide and carbon were used as the materials of the former and latter electrodes, respectively.

The current density in the cathodic electrolysis in the sodium chloride aqueous solution and in the electrolytic surface-roughening treatment was 25 A/dm$^2$ and 50 A/dm$^2$, respectively.

The condition of a neutral salt electrolyte in the third step treatment in which cathodic electrolysis was performed in the neutral salt aqueous solution for removing smut and the like was such that a 5% sodium chloride aqueous solution was used at a temperature of 50° C. A DC voltage to be used for the cathodic electrolysis in the sodium chloride aqueous solution was shunted from the AC power source used for the electrolytic surface-roughening treatment using thyristors. The ratio of area between an electrode to be used for the cathodic electrolysis in the sodium chloride aqueous solution and the electrode used for the electrolytic surface-roughening treatment in the acid electrolyte was 1:9. Iridium oxide was used as the material of the electrode. The current density was 25 A/dm$^2$. When the surface of the thus treated aluminum plate was observed with a scanning electron microscope, the aluminum plate had a roughened surface so uniform as to be suitable for a printing plate.

Thus, an aluminum plate is subject to continuous cathodic electrolysis in a neutral salt aqueous solution, electrochemically surface-roughened in an acid electrolyte, and then subject to cathodic electrolysis in a neutral salt aqueous solution so as to perform smut removal so that a support for a printing plate can be produced continuously and advantageously without using sodium hydroxide.

In a third embodiment of the present invention, the electrolytical treatment of an aluminum plate as a cathode in a neutral salt electrolyte as defined according to the present invention means that electrolytically treatment is performed on an aluminum plate while a DC voltage is applied between the aluminum plate and an electrode opposite thereto. "DC voltage" means a voltage having a polarity which does not change, and includes a continuous DC current, a comb-like waveform, or a voltage obtained by rectifying an AC current through a semiconductor element.

The neutral salt aqueous solution as defined according to the present invention is an aqueous solution of a salt such as disclosed in Japanese Unexamined Patent Publications Nos. Sho-52-26904 and Sho-59-11295, for example, an alkali metal halide or alkali metal nitrate, particularly preferably, sodium chloride or sodium nitrate. It is preferable to select the pH and the concentration to be 6–8 and 0.1–10%, respectively. As the electrode disposed in opposition to an aluminum plate so as to perform the cathodic electrolysis according to the present invention, platinum, ferrite, iridium oxide, and the like may be used.

If the electrolytic treatment time is too long or too short, an optimum roughened surface cannot be obtained. It is preferable to select the electrolytic treatment time to be in a range from 5 to 90 seconds. Further, it is preferable to select the current density of the AC current used for the cathodic electrolysis according to the present invention to be 1–100 A/dm$^2$. It is preferable to select the electrolytic treatment time to be in a range from 5 to 90 seconds.

The anodizing treatment as defined according to the present invention means a method in which a DC voltage is applied across an aluminum plate and an electrode opposite thereto in an electrolyte, such as sulfuric acid or phosphoric acid, so that an oxide coating is formed with the aluminum plate as an anode.

The surface-roughening treatment according to the present invention includes a mechanical surface-roughening method such as ball graining or brush graining, and an electrolytic surface-roughening method for electrochemically surface-roughening an aluminum plate in an acid electrolyte such as hydrochloric acid or nitric acid.

Next, referring to FIGS. 4 and 5, third embodiments of the present invention will be described.

Figure 4:
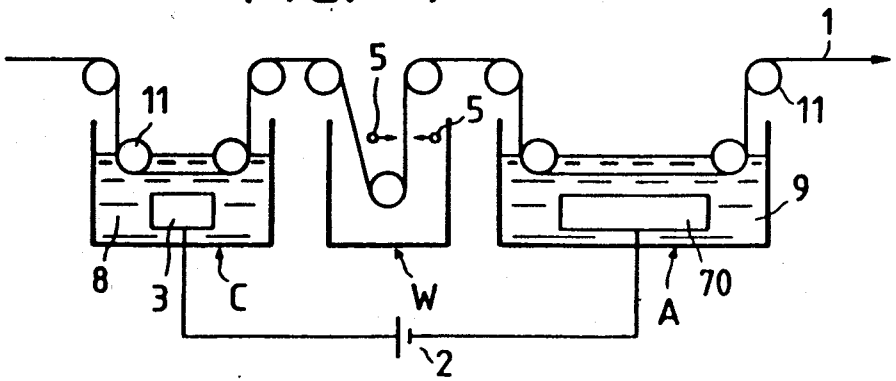
FIGS. 4 and 5 are schematic diagrams of treatment equipment for practicing third embodiments of the present invention.

In FIG. 4, a surface-roughened aluminum plate is subject to cathodic electrolytic treatment in a neutral salt aqueous solution at between the aluminum plate and an anode 3 of a DC power source 2 commonly used to the next anodizing step A so as to shape the roughed surface of the support in the cathodic electrolytic step C. Then, the thus treated aluminum plate is washed with water in the washing step W. Further, an anodic oxide coating is formed on the thus treated aluminum plate surface at between the aluminum plate and a cathode 70 of the DC power source 2.

Figure 5:
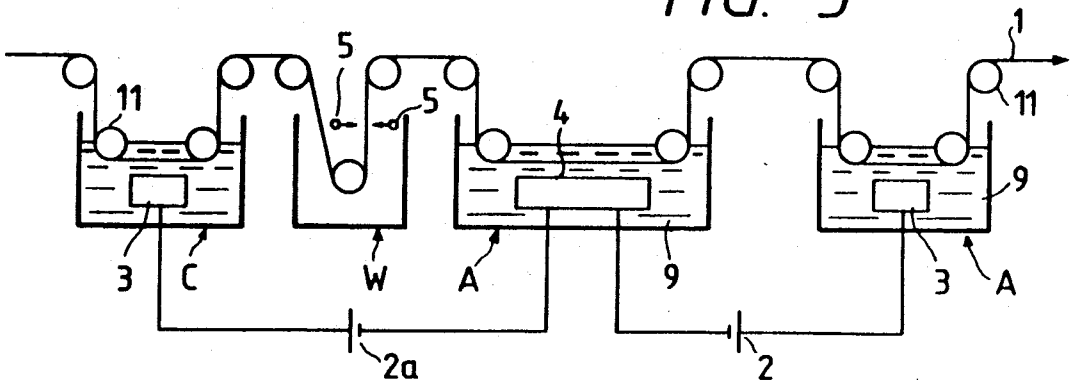
Figure 6:
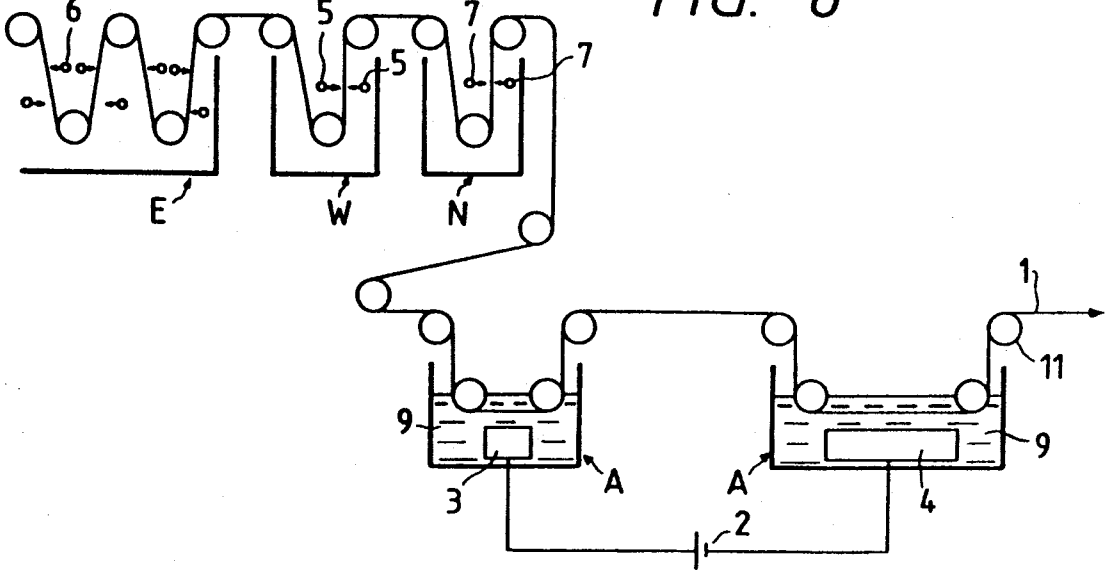
FIG. 6 shows a conventional method in which after-treatment following the surface-roughening treatment is performed using a chemical etching treatment.
Figure 7:
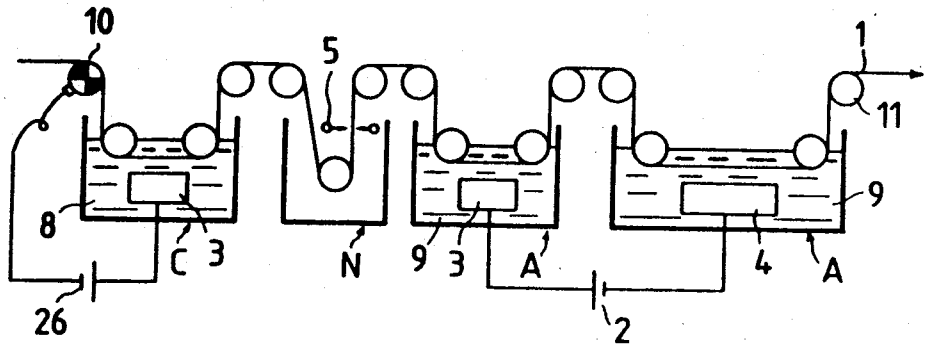
FIG. 7 shows, as a comparative example, a method in which after-treatment by cathodic electrolysis in a neutral salt aqueous solution is performed using a conductor roll.

In FIG. 5, first, a surface-roughened aluminum plate is subject to cathodic electrolytic treatment in a neutral salt aqueous solution between the aluminum plate and an anode 3 of a DC power source 2 commonly used in the next anodizing step A so as to shape the roughened surface of the support in the cathodic electrolytic step C, similarly to the case of FIG. 4. In the next anodizing step A, however, an anodic oxide coating is formed on the aluminum plate surface in two baths using an exclusive DC power source 2 in addition to the power source 2a in the same manner as in the case of FIG. 6 or 7.

Although examples of the third embodiment of the present invention will be described hereunder, the present invention is not limited to those examples.

EXAMPLE 3

A JIS 1050-H18 aluminum plate was surface-roughened using a nylon brush and suspension of 400 meshes, and then sufficiently washed with water. Next, in the apparatus of FIG. 4, the aluminum plate was electrolytically treated for 15 seconds at a current density of 20 A/dm$^2$ using a 5% sodium chloride aqueous solution of 50° C. as a neutral salt aqueous solution and by using a 15% sulfuric acid aqueous solution of 33° C. as an acid electrolyte, and then washed with water.

When the surface of the aluminum plate was observed with a scanning electron microscope, the aluminum plate had a roughened surface so uniform as to be suitable for a support for a printing plate. Further, an anodic oxide coating having a thickness of 2.7 g/m$^2$ was uniformly formed.

EXAMPLE 4

A JIS 1050-H18 aluminum plate was subject to a electrolytic surface-roughening treatment in a hydrochloric acid aqueous solution at 35° C. at a current density of 40 A/dm$^2$ for 20 seconds, and then washed with water. Next, in the apparatus of FIG. 4, the aluminum plate was electrolytically treated for 15 seconds at a current density of 20 A/dm$^2$ using a 5% sodium chloride aqueous solution of 50° C. as a neutral salt aqueous solution and by using a 15% sulfuric acid aqueous solution of 33° C. as an acid electrolyte, and then washed with water. When the surface of the aluminum plate was observed with a scanning electron microscope, the aluminum plate had a roughened surface so uniform as to be suitable for a support for a printing plate. No smut component due to the electrolytic surface-roughening in the hydrochloric acid aqueous solution was observed. Further, an anodic oxide coating having a thickness of 2.7 g/dm$^2$ was uniformly formed.

By the method for producing a support for a printing plate in which a surface-roughened aluminum plate defined according to the present invention is electrolytically treated as a cathode in a neutral salt aqueous solution and then anodized, characterized in that a DC power source is commonly used as a power source for the cathodic electrolytic treatment and as a power source for the anodizing treatment, it has become possible to advantageously perform after-treatment of the surface-roughening surface of an aluminum plate without causing problems such as perforation by sparks.

In a fourth embodiment of the present invention, electrochemical surface-roughening using an AC current in an acid electrolyte as defined according to the present invention means that an AC current is supplied across an aluminum plate and a counter electrode in an acid electrolyte containing metal ions to thereby perform electrochemical surface-roughening on the aluminum plate. The acid electrolyte as defined according to the present invention may be any of those used for electrochemical surface-roughening using common AC current. However, a particularly preferable one is a solution containing nitric acid in an amount of 5–15 g/l. A salt group such as aluminum nitrate, aluminum chloride, ammonium nitrate, ammonium chloride, manganese nitrate, manganese chloride, iron nitrate, iron chloride, or the like, which contains $NO_3^-$ or $Cl^-$, may be added to the electrolyte. As the material of the counter electrode for supplying the aluminum plate with AC current as defined according to the present invention, it is preferable to use carbon.

Figure 9:
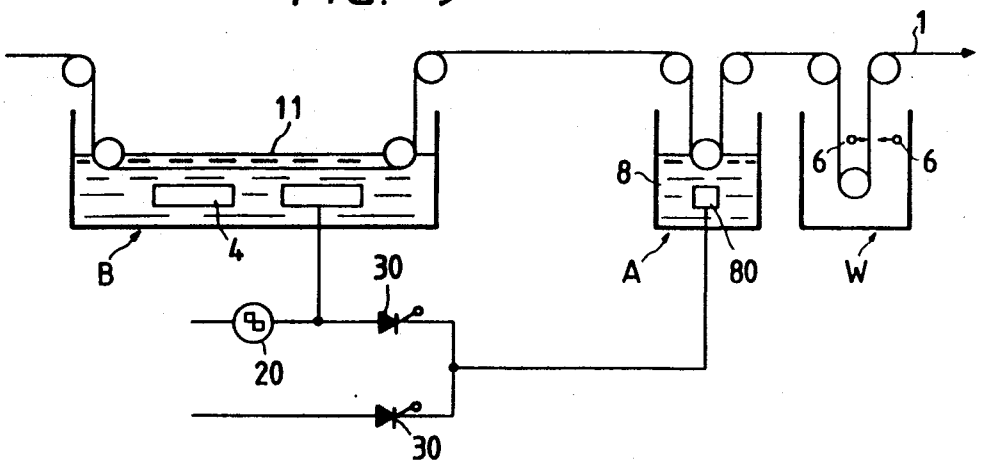
Figure 10:
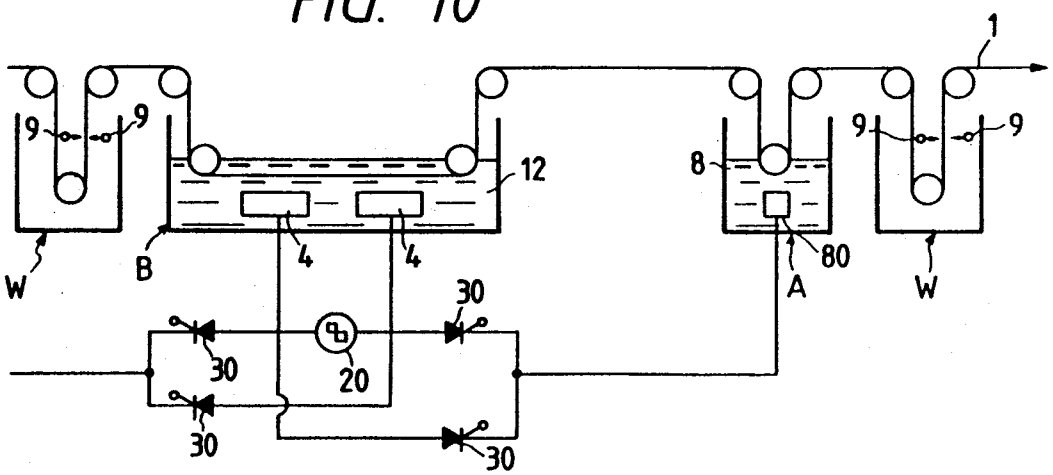

The neutral salt aqueous solution as defined according to the present invention is an aqueous solution of such a salt as disclosed in Japanese Unexamined Patent Publications Nos. Sho-52-26904 and Sho-59-11295, for example, an alkali metal halide or alkali metal nitrate, particularly preferably, sodium chloride or sodium nitrate. It is preferable to select the pH and the concentration to be 6–8 and 0.1–10%, respectively. As the electrode disposed in opposition to an aluminum plate so as to perform the cathodic electrolysis according to the present invention, platinum, ferrite, iridium oxide, and the like may be used, and, of them, ferrite and iridium oxide are particularly preferable. If the electrolytic treatment time is too long or too short, an optimum roughened surface cannot be obtained. It is preferable to select the electrolytic treatment time to be in a range from 5 to 90 seconds. Further, it is preferable to select the current density of the AC current used for the cathodic electrolysis according to the present invention to be 1–100 A/dm$^2$. According to the present invention, immersion of the aluminum plate in a sodium hydroxide, a sulfuric acid, a phosphoric acid, a nitric acid, a hydrochloric acid, a fluoric acid, a chromic acid, or the like, may be performed for the purpose of chemically washing the surface of the aluminum plate before the electrochemical surface-roughening treatment. When the cathodic electrolysis treatment process according to the present invention is provided as the electrochemical preprocess as shown in FIG. 9 or 10 in embodying the present invention, particularly, degreasing and dissolution of an aluminum plate surface layer are performed by a surface denaturation effect, and in many cases therefore the chemical washing treatment for electrolytic surface-roughening can be omitted.

The improved process for producing a support for a printing plate according to the present invention will be described with reference to the accompanying drawings hereunder.

Figure 8:
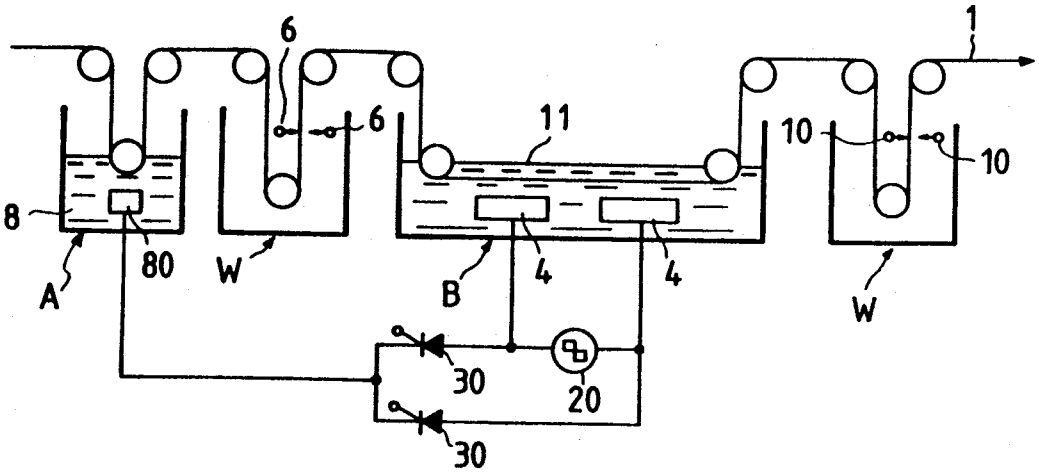
FIGS. 8, 9, and 10 are schematic views of treatment equipment for implementing fourth embodiments of the present invention.

FIG. 8 shows a method wherein in a cathodic electrolysis pretreatment in which an aluminum plate 1 is subject to pretreatment by cathodic electrolysis treatment in a neutral salt aqueous solution 8 between the aluminum plate 1 and an anode in place of the conventional pretreatment washing step such as alkali treatment or the like for an aluminum plate, a shunted DC current obtained by rectifying an AC current from an AC power source 20 through thyristors 30 is supplied to an auxiliary electrode 80 disposed in opposition to the aluminum plate 1.

The aluminum plate which has been electrolyzed and washed in the cathodic electrolysis step A is washed with water through injection of cleaning water from spray nozzles 6, and then sent to the next electrolytic surface-roughening step B. In this step, the aluminum plate 1 is electrolytically surface-roughened in an acid electrolyte 11 between the aluminum plate and main electrodes 4 using AC current supplied from the AC power source 20. Then, the AC electrolytically surface-roughened aluminum plate is sent to the washing step W.

In the configuration of FIG. 8, cathodic electrolysis using a rectified shunted current from the power source for the electrolytic surface-roughening step B is utilized as the pretreatment for the aluminum plate 1 before surface-roughening. On the other hand, FIG. 9 shows a process diagram in which after-treatment including removal of aluminum hydroxide on the roughened surface of an electrolytically surface-roughened aluminum plate and well shaping of edge portions of formed pits is performed utilizing a shunted current obtained by rectifying, through thyristors 30, an AC current which is supplied from an AC power source 20 so as to be used in the electrolytic surface-roughening step B.

That is, in FIG. 9, first, an aluminum plate 1 is AC-electrolytically surface-roughened in an acid electrolyte 11 between the aluminum plate 1 and main electrodes 4 by power supplied from the AC power source 20 in the electrolytic surface- roughening step B. Next, the aluminum plate 1 is subject to cathodic electrolysis in a neutral salt aqueous solution 8 between the aluminum plate and an auxiliary electrode 80 by supplying a shunted DC current obtained by rectifying, through the thyristors 30, an AC current supplied from the AC power source 20 in the cathodic electrolysis step A. The aluminum plate 1 which has been subject to treatment such as removal of an aluminum hydroxide and the like in the cathodic electrolysis step A is sent to the washing step W so as to be washed with cleaning water from spray nozzles 6.

FIG. 10 is an explanatory view in the case where the cathodic electrolysis treatment of FIG. 1 using a rectified shunted current from the AC power source 20 which is performed as the pretreatment process and the cathodic electrolysis after-treatment of FIG. 9 for the aluminum plate 1 using a rectified shunted current supplied also from the AC power source are simultaneously carried out, and in the pretreatment and the after-treatment cathodic electrolysis treatment is performed in a neutral salt aqueous solution 8 between an auxiliary electrode 80 and an aluminum plate by supplying a shunted DC current obtained by rectifying, through thyristors 30, an AC current supplied from an AC power source 20 for performing the electrolytic surface-roughening step B. A detailed description of FIG. 10 is apparent from the descriptions of FIGS. 8 and 9.

Current adjustment in the cathodic electrolysis washing treatment in a neutral salt aqueous solution according to the present invention can be controlled on the basis of the ratio of the area between main electrodes and an electrode to be used the cathodic electrolysis or the ignition timing of thyristors, GTOs, or transistors.

Although examples of the fourth embodiment of the present invention will be described hereunder, the present invention is not limited to those examples.

EXAMPLE 5

A JIS 1050-H18 aluminum plate was continuously electrolytically surface-roughened in the apparatus shown in FIG. 8. The condition of a neutral salt electrolyte at this time was such that a 5% sodium chloride aqueous solution was used at a temperature of 50° C. The condition of the acid electrolyte was such that a 1% hydrochloric acid aqueous solution was used at a temperature of 35° C. The area ratio of an electrode used for the cathodic electrolysis to that used for the electrolytic surface-roughening in the acid aqueous solution was 2:8. Carbon and iridium oxide were used as the materials of the former and latter electrodes, respectively. Thyristors were used as the rectifier devices for performing shunting from a current to be used for the surface roughening. The current density in the electrolytic surface-roughening treatment and the cathodic electrolytic treatment were 50 A/dm$^2$ and 25 A/dm$^2$ respectively. The aluminum plate was immersed for 60 seconds in an aqueous solution at 60° C. containing sulfuric acid in an amount of 360 g/l and then washed with water so as to remove a smut component generated in the electrolytic surface-roughening. When the aluminum plate surface was observed with a scanning electron microscope, the aluminum plate was uniformly surface-roughened.

EXAMPLE 6

A JIS 1050-H18 aluminum plate with its surface dissolve-washed by 2 g/m$^2$ in a sodium hydroxide aqueous solution was continuously electrolytically surface-roughened in the apparatus of FIG. 9. The condition of a neutral salt electrolyte at that time was that a 5% sodium chloride aqueous solution was used at a temperature of 50° C. The condition of an acid electrolyte was that a 1% hydrochloric acid aqueous solution was used at a temperature of 35° C. The area ratio of the electrode to be used for the cathodic electrolysis to the electrodes to be used for the electrolytic surface-roughening in the acid aqueous solution was 2:8. As the materials of the former and latter electrodes, carbon and iridium oxide were used respectively. Thyristors were used as the rectifier devices for performing shunting from a current to be used for the surface roughening. The current density in the electrolytic surface-roughening treatment and the cathodic electrolytic treatment were 50 A/dm$^2$ and 25 A/dm$^2$, respectively. When the surface of the aluminum plate was observed with a scanning electron microscope, no smut generated by the electrolytic surface-roughening was observed, and the aluminum plate was uniformly surface-roughened. No dissolution of carbon constituting main electrodes was generated even after long treatment.

EXAMPLE 7

Figure 12:
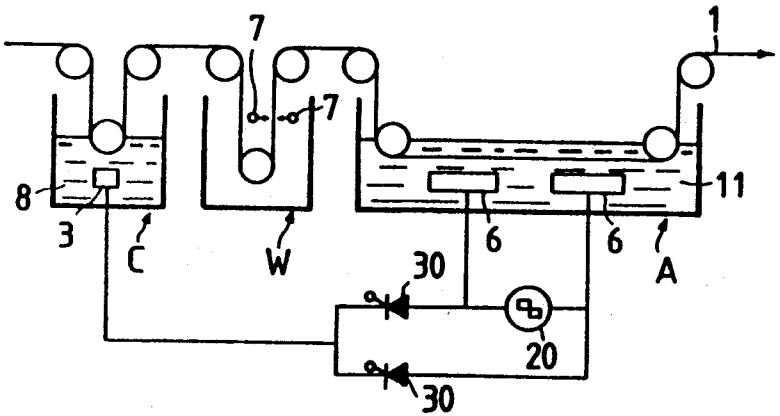
FIGS. 12 is schematic diagrams of treatment equipment for carrying out fifth embodiments of the present invention.

A JIS 1050-H18 aluminum plate was continuously electrolytically surface-roughened in the apparatus shown in FIG. 12. The condition of a neutral salt electrolyte at this time was such that a 5% sodium chloride aqueous solution was used at a temperature of 50° C. The condition of an acid electrolyte was such that a 1% hydrochloric acid aqueous solution was used at a temperature of 35° C. The area ratio of an electrode used for the cathodic electrolysis to that used for the electrolytic surface-roughening in the acid aqueous solution was 2:8. Carbon and iridium oxide were used as the materials of the former and latter electrodes, respectively. Thyristors were used as the rectifier devices for performing shunting from a current to be used for the surface roughening. The current density in the electrolytic surface-roughening treatment and the cathodic electrolytic treatment were 50 A/dm$^2$ and 25 A/dm$^2$, respectively. The surface of the aluminum plate after the cathodic electrolysis and washing treatment and before the electrolytic surface-roughening was oxidized silver, and no rolling oil or the like was observed. When the surface of the aluminum plate after the electrolytic surface-roughening was observed, no surface unevenness which was apt to be generated when etching treatment in an alkaline solution was omitted was generated. When the surface of the aluminum plate was observed with a scanning electron microscope, the aluminum plate was surface-roughened so uniformly as to be suitable for a support for a printing plate.

An aluminum plate (including an aluminum alloy plate) is electrolytically treated as a cathode in the neutral salt electrolyte and electrochemically surface-roughened in the acid aqueous solution so that a support for a printing plate can be advantageously produced.

COMPARATIVE EXAMPLE

Figure 11:
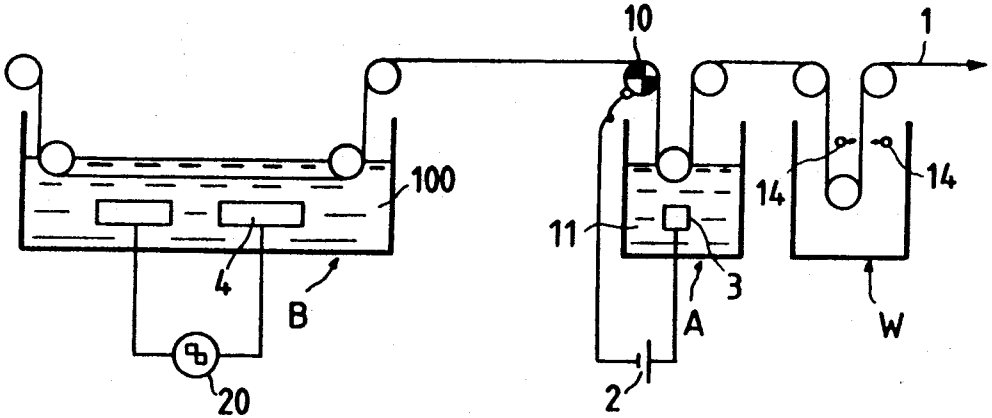
FIGS. 11 and 13 are a schematic view of treatment equipment showing a comparative example.
Figure 13:
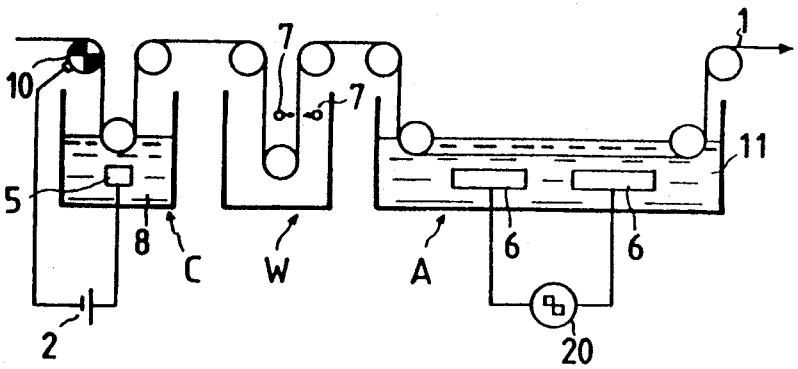

A JIS 1050-H18 aluminum plate was continuously electrolytically surface-roughened in the apparatus shown in FIGS. 11 and 13. The condition of a neutral salt electrolyte at this time was such that a 5% sodium chloride aqueous solution was used at a temperature of 50° C. The condition of the acid electrolyte was such that a 1% hydrochloric acid aqueous solution was used at a temperature of 35° C. Iridium oxide and carbon were used as the material of an electrode to be used in the neutral salt electrolyte and the material of main electrodes to be used in the acid electrolyte respectively. The current density was adjusted so as to be 50 $A/dm^2$ in the electrolytic surface-roughening treatment and 25 $A/dm^2$ in the cathodic electro treatment. As a result, it was recognized that sparks were generated on the surface of the treated aluminum plate and carbon constituting the main electrodes was dissolved so that the acid electrolyte had become almost black.

By the method for producing a support for a printing plate in which an aluminum plate is continuously electrochemically surface-roughened in an acid electrolyte using an AC current, characterized in that the current used for the surface roughening is partially shunted through rectifier devices and the thus obtained shunted current is used for cathodic electrolysis in the neutral salt aqueous solution according to the present invention, surface denaturation of an aluminum plate can be advantageously performed without generating any spark between the aluminum plate and a conductor roll, so that a support for a printing plate can be continuously produced without generating any dissolution of carbon constituting the main electrodes to be used for electrolytic surface-roughening.

According to a fifth embodiment of the present invention, the neutral salt aqueous solution as defined according to the present invention is an aqueous solution of such a salt as disclosed in Japanese Unexamined Patent Publications Nos. Sho-52-26904 and Sho-59-11295, for example, an alkali metal halide or alkali metal nitrate, particularly preferably, sodium chloride or sodium nitrate. It is preferable to select the pH and the concentration to be 6–8 and 0.1–10%, respectively. As the electrode disposed in opposition to an aluminum plate so as to perform the cathodic electrolysis according to the present invention, platinum, ferrite, iridium oxide, and the like may be used.

The continuous electrolytical treatment of an aluminum plate as a cathode in a neutral salt electrolyte according to the present invention means that electrolytically treatment is performed on the aluminum material while a DC voltage is applied between the aluminum plate and an electrode opposite thereto. "DC voltage" means a voltage having a polarity which does not change, and includes a continuous DC current, a comb-like waveform, a voltage obtained by rectifying an AC current through a semiconductor element or the like.

According to the present invention, a voltage to be supplied for cathodic electrolysis may be obtained by providing a DC power source 2 as shown in FIG. 13. In a method in which an aluminum plate is continuously electrochemically surface-roughened in an acid electrolyte by using an AC current as shown in FIG. 12, on the other hand, the current to be used for the surface roughening may be partially shunted through rectifier devices so that the thus obtained shunted current is used for cathodic electrolysis in a neutral salt aqueous solution.

That is, pretreatment for an aluminum plate is performed by cathodic electrolysis of the aluminum plate made opposite to an anode 3 of a DC power source 2 in a neutral salt aqueous solution 8 in the cathodic electrolysis step C as shown in FIG. 13. In this case, power supply to the aluminum plate is performed with a conductor roll 10.

FIG. 12 is a schematic view showing another embodiment of the present invention. Pretreatment (cleaning) of an aluminum plate is performed in the cathodic electrolysis step C in such a manner that a part of a current from an AC power source 20 (rectified by thyristors 30) is supplied to an anode 5 and the surface of the aluminum plate 1 disposed in opposition to the anode 3 is subject to cathodic electrolysis in a neutral salt aqueous solution 8. Further, the thus treated aluminum plate is washed with water through injection of water by means of spray nozzles in the washing step W, and then anodized in an acid electrolyte 11 using an AC current supplied from the AC power source 20 in the anodizing step A.

The electrochemical surface-roughening in an acid electrolyte according to the present invention means that a voltage is supplied between an aluminum plate and a counter electrode to thereby electrochemically surface-roughen the aluminum plate. An AC voltage or a DC voltage may be used as the voltage in this case, and almost all the known electrochemical surface-roughening methods can be applied.

The acid electrolyte as defined according to the present invention may be any of those used for electrochemical surface-roughening using a usual AC current. However, a particularly preferable one is a solution containing a nitric acid by 5–15 (g/l). A salt group such as aluminum nitrate, aluminum chloride, ammonium nitrate, ammonium chloride, manganese nitrate, manganese chloride, iron nitrate, iron chloride, or the like, which contains $NO_3^-$ or $Cl^-$, may be added to the electrolyte.

It is preferable to select the density of a DC current to be used for the cathodic electrolysis as defined according to the present invention to be 1–100 $A/dm^2$. It is preferable to select the electrolytic treatment time to be in a range from 0.1 to 90 seconds. In a neutral salt aqueous solution of pH 6–8, which is a particularly advantageous condition, dissolved aluminum ions can be continuously removed from the neutral salt aqueous solution by filtration or centrifugal separation because the aluminum ions are precipitated in the form of an aluminum hydroxide or an aluminum oxide hydrate.

According to the present invention, immersion treatment of an aluminum plate in a sodium hydroxide, a sulfuric acid, a phosphoric acid, a nitric acid, a hydrochloric acid, a fluoric acid, a chromic acid, or the like may be performed for the purpose of chemically washing the surface of the aluminum plate before or after the cathodic electrolysis treatment in the neutral salt electrolyte. Sufficient degreasing and sufficient dissolution of an aluminum plate surface layer, however, are performed by a surface denaturation effect by the cathodic electrolysis treatment according to the present invention, and it is therefore possible to omit a chemical washing treatment for electrolytic surface-roughening.

Although examples of the fifth embodiment of the present invention will be described hereunder, the present invention is not limited to those examples.

What is claimed is:

1. A method for producing a support for a printing plate, comprising:

providing an aluminum plate;

continuously conveying said aluminum plate through a plurality of chambers, one of said plurality of chambers containing an acid electrolyte and a second of said plurality of chambers containing a neutral salt aqueous solution for cathodic electrolysis of said aluminum plate;

supplying an AC current to said acid electrolyte contained in said one of said plurality of chambers;

continuously electrochemically surface-roughened said aluminum plate in said acid electrolyte by using said AC current, wherein said current to be used for said surface-roughening of said aluminum plate is partially shunted through rectifier devices and is used for cathodic electrolysis in said neutral salt aqueous solution; and washing said aluminum plate after said aluminum plate has undergone cathodic electrolysis in said neutral salt aqueous solution.

2. The method of claim 1, wherein said neutral salt aqueous solution is a 5% sodium chloride aqueous solution at a temperature of 50° C.

3. The method of claim 2, wherein said acid electrolyte is a 1% hydrochloric acid aqueous solution at a temperature of 35° C.

4. The method of claim 1, wherein said rectifier devices are comprised of thyristors.

* * * * *